US006102060A

United States Patent [19]

Howlett et al.

[11] Patent Number: 6,102,060

[45] Date of Patent: Aug. 15, 2000

[54] DETACHABLE LOCKING DEVICE FOR A CONTROL VALVE AND METHOD

[75] Inventors: Paul David Howlett; Mark Carmichael, both of Aberdeen, United Kingdom

[73] Assignee: Specialised Petroleum Services Ltd., Aberdeen, United Kingdom

[21] Appl. No.: 09/018,254

[22] Filed: Feb. 4, 1998

[30] Foreign Application Priority Data

Feb. 4, 1997 [GB] United Kingdom ..... 9702266

[51] Int. Cl.[7] ..... E03B 1/00

[52] U.S. Cl. ..... 137/1; 137/624.27; 137/71; 166/325; 166/331

[58] Field of Search ..... 137/624.13, 515, 137/515.5, 522, 523, 68.16, 71, 1, 624.27, 155; 166/319, 325, 331, 330, 323; 251/89

[56] References Cited

U.S. PATENT DOCUMENTS 3,807,428 4/1974 Watkins et al. ..... 137/624.27 X
3,954,138 5/1976 Miffre ..... 137/68.16 X
4,067,358 1/1978 Streich ..... 137/624.27 X
4,625,762 12/1986 Hassanzadeh et al. ..... 137/624.27
4,796,704 1/1989 Forrest et al. ..... 137/515 X

*Primary Examiner*—Kevin Lee
*Attorney, Agent, or Firm*—Ratner & Prestia

[57] ABSTRACT

A valve device for use downhole is described as comprising a body member and a channel through the body member through which fluid can flow. A moveable member is mounted within the body member, and comprises an obturating member for selectively obturating the channel. The moveable member is moveable between a first position in which the channel is not obturated and fluid flow through the channel is permitted, and a second position in which the channel is obturated and fluid flow through the channel is substantially prevented.

A method of preventing the fluid flow downhole is also described as comprising the steps of inserting a downhole tool comprising a valve device according to the present invention downhole and moving the moveable member from the first to the second position such that the obturating member obturates the channel.

18 Claims, 3 Drawing Sheets

DETACHABLE LOCKING DEVICE FOR A CONTROL VALVE AND METHOD

This invention relates to a valve device and method particularly, but not exclusively, for blocking the flow of fluid downhole in a casing string or liner string to enable the string above the tool to be tested for pressure integrity or to function tools located in the casing or liner string which are activated by pressure.

BACKGROUND OF THE INVENTION

When a borehole is drilled for hydrocarbon exploration, it is conventional to insert a casing string into the borehole to protect the borehole formation. A liner string can then be suspended within the casing string and can be connected to the top side by a drill string. Normally, cement is injected into the annulus between the outer surface of the casing string and the inner surface of the borehole in order to secure the casing string.

There are devices available that permit pressure testing of the casing string, or if present also permit pressure testing of the liner string, or which permit activation of pressure activated tools in the casing or liner string, the majority of these devices permitting pressure testing, or pressure activation respectively, after the cement has been inserted into the annulus.

However, in order to be able to pressure test the casing string after cementing, it is known to run in a packer tool. The packer tool comprises an outer expandable seal that when expanded seals against the inside of the casing string, which then permits pressure testing above the site of the seal. However, using such a packer tool can be detrimental to the casing string, as the packer tool exerts very high loads on casing when pressure testing, typically in the region of 10,000–15,000 psi. Further, the packer tool must be retrieved from the well after the testing operation has been completed.

Alternatively, a seat is provided at a suitable point on the inside of the casing or liner string so that when a plug is released, it travels down the casing or liner string and will hopefully land on the seat, thereby forming a seal so that pressure testing can occur above the plug. However, the plug and seat arrangement has the disadvantage that it is not certain that the plug will correctly land on the seat. The plug is normally released during the cementing operation and often does not land correctly on the seat, making it impossible to perform the pressure test. Further, the plug and seat pressure testing arrangement has the disadvantage that the cement is usually in position and has set or hardened by the time the pressure test is conducted. Therefore, if there is a leak in the system, the casing cannot be retrieved, resulting in expensive and time consuming remedial work to ensure pressure integrity.

Further, it has been known for the plug and seat pressure testing arrangement to fail during a pressure test. If this occurs, then the build up of high fluid pressure that precedes the failure can expel the cement from its intended location, and thus causes a poor cement job that requires remedial work.

If a packer, or the plug and seat arrangement is used after the cement has set, the high fluid pressure that is exerted on the casing can cause the metal casing to be bowed outward or expanded. This causes the cement to be displaced. Therefore, after the fluid pressure has been removed, the profile of relatively elastic metal casing will return to its original pre-pressure test state, but the cement may have set or hardened, and thus will not return to its original pre-pressure test state. Therefore, a micro-annulus may be formed between the outer diameter of the casing and the cement bond in the borehole, which may lead to gas migration up the borehole, and/or loss of zonal isolation.

In order to activate pressure operated tools located downhole, such as a conventional liner hanger system, or a conventional running tool for running a liner hanger system downhole, it is known to drop a ball down the casing string in the fluid path. The ball eventually lands on a ball seat located below the tool to be activated. Thus, the fluid path is blocked. This results in an increase in the fluid pressure, which can then activate the pressure operated tool. Then, when the pressure operated tool has been activated, the fluid pressure is increased such that the ball and/or the ball seat is sheared out of position, down the string. Fluid circulation can then continue in the same manner as before the ball was dropped.

However, there are various problems associated with this conventional apparatus and method for activating a pressure operated tool. The time taken for the ball to reach the ball seat can be considerable, and there can be problems with getting the ball to land on the ball seat, particularly in highly deviated wells such as horizontal wells, where the ball may have to travel a relatively long distance through a horizontal section of the well. Also, when the ball and/or the ball seat has been sheared out of position, the formation receives a hydraulic shock, which can lead to a loss of circulation of the fluid.

SUMMARY OF THE INVENTION

According to a first aspect of the present invention there is provided a valve device for use downhole comprising a body member; a channel through the body member through which fluid can flow; a moveable member mounted within the body member, the moveable member comprising an obturating member for selectively obturating the channel, the moveable member being moveable between a first position in which the channel is not obturated and fluid flow through the channel is permitted, and a second position in which the channel is obturated and fluid flow through the channel is substantially prevented.

The invention has the advantage that by selectively blocking the fluid flow channel, the pressure of fluid above the blocking mechanism is increased, and pressure testing of the casing, or setting of pressure activated tools in either a casing string or liner string, above the blocking mechanism, can be achieved.

Optionally, the valve device further comprises a detachable locking device that locks the moveable member in the first position, until a displacement system is actuated to unlock the detachable locking device.

Preferably, a narrow channel section is located in the channel and is connected to the moveable member.

Preferably, a biassing device biasses the moveable member in a direction substantially opposite to the direction of flow of fluid.

Typically, the moveable member is moved by a pressure drop of fluid over the narrow channel section, the force of which overcomes the biassing of the biassing device.

Preferably, the movement of the moveable member is restrained by a restraining mechanism to a predetermined cycle of movement in a longitudinal direction with respect to the axis of the valve device and a rotational direction about the axis of the valve device. Typically, the restraining mechanism comprises a first member mounted on the body member and the second member mounted on the moveable member, the two members cooperating to restrain the movement of the moveable member to the predetermined cycle.

Preferably, one of the members is a male member and the other member is a female member, and more preferably, a slot is formed in the female member into which the male member seats, the slot defining the cycle of movement of the moveable member. Typically, the female member is a cylindrical member, and the slot is formed around the circumference of the cylinder and preferably the slot is a "J" slot.

Typically, the first member is the male member, and the second member is the female member. Preferably, the "J" slot comprises at least one short travel section slot and at least one long travel section slot, and more preferably, there are more short travel section slots than long travel section slots. Most preferably, the first position of the moveable member is whilst the moveable member cycle is in a short travel section slot, and the second position is whilst the moveable member cycle is at the furthest travel of the long travel section slot.

Typically, the displacement system comprises a drop-ball seat which is coupled to the moveable member, and a drop-ball such that when the drop ball lands on the drop-ball seat, the force of the fluid pressure upstream of the drop-ball seat unlocks the locking device, in use.

Typically, the detachable locking device includes at least one shear pin that extends from one of either of the body member or the moveable member, through to a shear pin hole located in the other of the body member or the moveable member.

The drop-ball seat may be selectively slidably coupled to the moveable member, such that before the detachable locking device is actuated, the drop-ball seat is locked to the moveable member, and after the detachable locking device is actuated, the drop-ball seat is slidably coupled to the moveable member.

Typically, after the detachable locking device is actuated, the drop-ball seat and drop ball move from a first drop-ball seat position, to a second drop-ball seat position. Typically, when the drop-ball seat is in the first drop-ball seat position, the drop-ball seat retains a detachable latching device mounted on the moveable member in a latching relationship with the body member. Typically, when the drop-ball seat is in the second drop-ball seat position, the drop-ball seat does not retain the detachable latching device, and the detachable latching device is permitted to detach from the latching relationship with the body member.

Optionally, the detachable latching device comprises at least one finger mounted on the moveable member which latches onto a latching shoulder mounted on the body member.

According to a second aspect of the present invention, there is provided a method of preventing the fluid flow downhole comprising the steps of inserting a downhole tool comprising a valve device of the first aspect of the present invention downhole; and moving the moveable member from the first to the second position such that the obturating member obturates the channel.

Optionally, the downhole tool is inserted into a collar where the collar is inserted into a casing or liner string.

The tool may be connected to the collar by a screw thread formation, or alternatively the tool may be connected to the collar by a screw thread formation and cement.

Alternatively, an outer member of the tool is provided with screw thread formations to permit the tool to be coupled into the casing string.

According to a third aspect of the present invention there is provided a method of re-establishing fluid flow downhole following a method of preventing fluid flow in accordance with the second aspect of the invention, the method of re-establishing fluid flow downhole comprising the steps of increasing or reducing the pressure of the fluid downhole to actuate a re-circulation means to re-establish fluid flow.

BRIEF DESCRIPTION OF THE DRAWINGS

An example of a valve device will now be described, by way of example only, with reference to the accompanying drawings in which.

DESCRIPTION OF PREFERRED EMBODIMENTS

Figure 1:
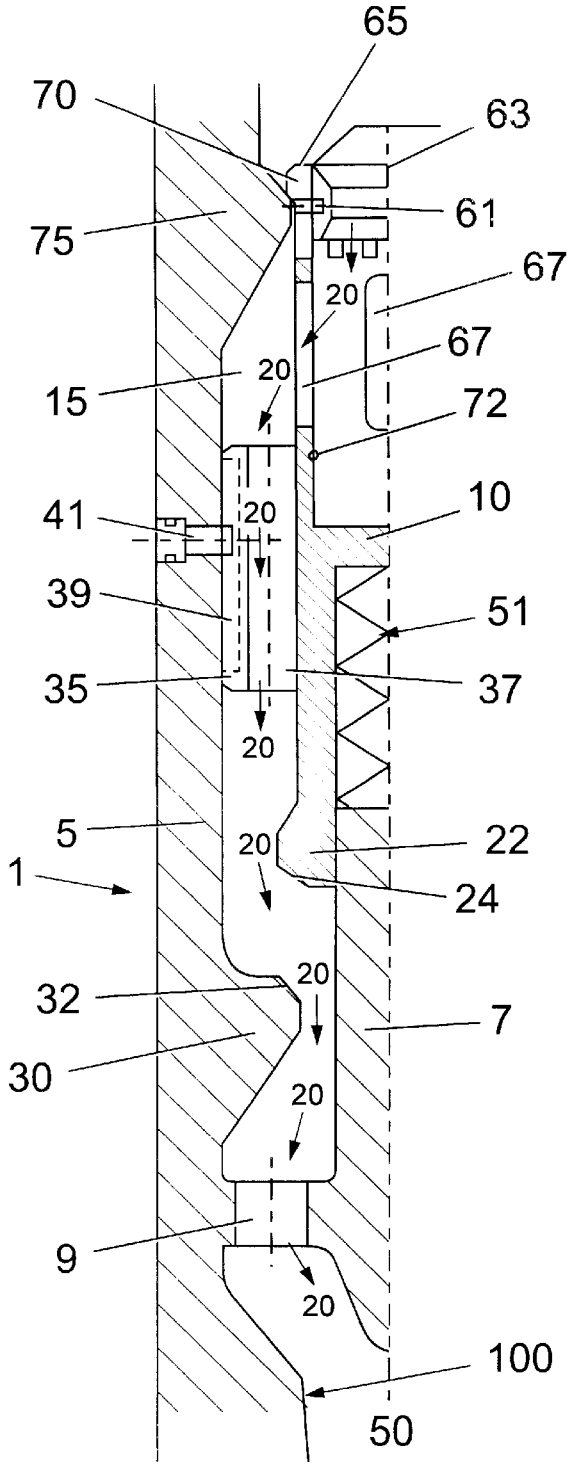
FIG. 1 is a half sectional side view of a first example of a downhole tool incorporating a valve device in accordance with the present invention.

FIG. 1 shows a downhole tool 1 incorporating a valve device comprising an outer body member 5, an inner lower body member 7 secured to the outer body member 5 by a screw threaded connection 29, and an inner piston 10. In between the outer body member 5 and the piston 10 is a channel 15 through which the fluid flows, with the direction of the fluid flow being indicated by arrows 20. Ports 9 are provided between the outer body member 5 and the inner lower body member 7 to provide for the channel 15 therebetween.

The piston 10 is slidably mounted within the body member 5 in a longitudinal direction of movement with respect to the longitudinal axis 50 of the body member 5, and a rotational direction about the longitudinal axis 50 of the body member 5. A valve 22 is mounted at the lower end of the piston 10.

The piston 10 is moveable between a first position (as depicted in FIG. 1) in which fluid can flow in the direction of arrows 20 from above the tool 1, through the channel 15, and out of the bottom of the tool 1, to a second position (not shown) in which an angled face 24 of the valve 22 makes contact with a correspondingly angled seat 32 of an inwardly facing shoulder 30 of the outer body member 5. When the piston 10 is in the second position, the fluid flow path as depicted by the arrows 20 is blocked, and accordingly the pressure of fluid above the valve 22 increases.

A cylindrical sleeve 35 is mounted around the outer circumference of a section of the piston 10. The cylindrical sleeve 35 has at least one narrow channel or port 37 running through the entire length of the sleeve 35, where the port 37 provides the fluid path as depicted by the arrows 20. However, a restriction nozzle or jet (not shown), such as a VISCO (™) jet may be mounted within the port 37 in order to further restrict the flow of fluid, as depicted by arrows 20, where necessary. A continuous "J" slot 39 is formed around the outer circumference of the cylindrical sleeve 35.

A male member or a key 41 projects inwardly from the outer body member 5, and seats in the continuous "J"slot 39. The continuous "J" slot 39 has two short travel positions 45*a* and 45*b* and one long travel position 47, the magnitude of travel being with respect to the travel of the piston 10 in a direction toward the shoulder 30 of the outer body member 5. The continuous "J" slot 39 is also formed in a manner such that the interaction between it and the key 41 permits the cylindrical sleeve 35 to only rotate about the longitudinal axis 50 of the tool 1 in one direction.

The piston 10 is biassed away from the shoulder 30 by a return spring 51.

The piston 10 can, optionally, be locked in the first position if required, by inserting a shear pin 61 into a pin hole (not shown) in the piston 10, and pushing the shear pin 61 through the pin hole until it lands in a shear pin seat (not shown) on the outer body member 5, at some time before the tool 1 is inserted downhole.

In operation of the tool 1, the tool 1 is inserted into the casing string (not shown), or the liner string (not shown), and is secured in either string by a collar (not shown) that connects with the tool 1 by a screw thread formation (not shown) between the collar and the tool 1, or a screw thread formation and cement (not shown). The tool 1 would normally be positioned close to or adjacent to the bottom of the casing string or liner string.

Optionally, the tool 1 can be run in downhole with the shear pin 61 inserted into the shear pin seat, and this allows fluid to flow through the tool 1 in the direction of arrows 20 until a drop-ball (not shown) is inserted into the fluid flow. The drop-ball is of such a dimension as to come to a rest when it reaches a ball seat 63 mounted within a collet 65 at the upstream end of the piston 10. The fluid pressure upstream of the drop-ball will build up until it reaches the breaking force of the shear pin 61. When the shear pin 61 breaks, the collet 65 is forced toward upper face of the piston 10 by the fluid pressure. Latching fingers 70 project in the opposite direction to the fluid flow to form the opposite end of the piston 10 with respect to the valve 22 end of the piston 10.

When the uppermost portion of the collet 65 clears the latching fingers 70, the latching fingers 70 are permitted to collapse sufficiently inwardly to clear upper shoulder 75 mounted on the outer body member 5.

The collet 65 and drop-ball continue travelling toward the upper face 69 until the collet 65 makes contact with the upper face 69. The collet 65 is restrained from travelling back toward fingers 70 by a one way snap ring 72 which allows the collet 65 to travel past it in the collet 65 direction of travel toward the upper face 69, but restrains the collet 65 from travelling back toward fingers 70.

Thereafter, the collet 65 and the drop-ball provide a further surface area upon which the fluid pressure can act. Therefore, the piston 10 and hence the valve 22 will move towards the shoulder 30. Thus, when the collet 65 clears slots 67 mounted in the piston 10, fluid flow will again be established through the tool 1 in the direction of arrows 20.

Alternatively, particularly to allow the casing string or liner string to be pressure integrity tested at various depths, or to activate pressure operated tools such as liner hanger systems, without raising the problems encountered by use of a drop ball, the tool 1 may be included in the string without the shear pins in place, in which case the cycling operation of the tool 1 is initiated solely by increasing the fluid flow. In this situation, the upper face 69 provides a further surface area upon which the fluid pressure can act. Also, the collet 65, and latching finger arrangement 70 can be omitted.

In either scenario, as the fluid flow through the tool 1 increases, a pressure drop is built up over the port 37 in the cylindrical sleeve 35 and this pressure drop will move the cylindrical sleeve 35 around its cycle due to the key 41 seating within the continuous "J" slot 39. Assuming that the key 41 first seats in the short travel position 45*a* which is shown in FIG. 2, the piston 10 will be restrained so that the valve 22 is spaced apart from the shoulder 30, and hence fluid flow can continue in the direction of arrows 20.

When the fluid flow through the tool 1 is cycled once, (that is the fluid flow velocity is decreased so that the biassing action of the return spring 51 overcomes the pressure drop over port 37 and the key moves into zero travel position 46*a*) and then the fluid flow velocity is increased so that the key 41 moves into the second short travel position 45*b*, then the tool 1 still allows fluid flow in the direction of arrows 20. However, if the fluid flow through the tool 1 is cycled again, the piston moves toward shoulder 30, the cylindrical sleeve 35 rotates so that the key passes the second 0 travel position 46*b* and lands in long travel position 47, then the valve 22 will contact shoulder 30, and fluid flow through the tool 1 will be blocked. In this situation, fluid pressure can be increased above the valve 22 so that the casing string, or liner string pressure integrity can be assessed, or activation of pressure operated tools can be achieved. Once the relevant operation has been completed, the pressure can be bled off, and the spring 51 moves the valve 22 away from the shoulder 30, and circulation of fluid is re-established.

It may be preferable to have a higher ratio of short travel positions 45*a* and 45*b* to long travel positions 47, so that the tool 1 only blocks off the fluid after many cycles of the fluid flow. The reason for this is that an operator would normally only want to block the fluid flow in order to either test the pressure integrity of the casing string or liner string, or activate pressure operated tools, after he has performed operations which require cycling of the fluid flow. However, it is difficult to increase the number of short travel positions in the continuous "J" slot 39 on the cylindrical sleeve 35, as the surface area of the cylindrical sleeve 35 is limited by the outside diameter of the tool 1 which may be approximately 6 inches. The inside diameter of the tool 1 at the point marked 100 is approximately 2 inches.

Figure 2:
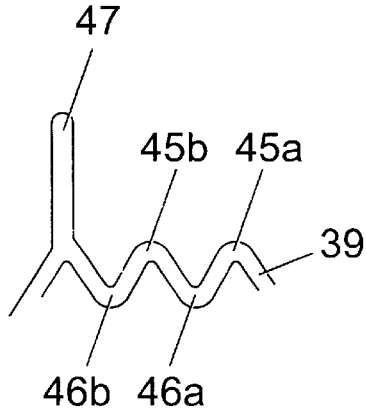
FIG. 2 is a side view of continuous "J" slot sleeve, which is incorporated in the downhole tool of FIG. 1, laid out flat for greater clarity.
Figure 3:
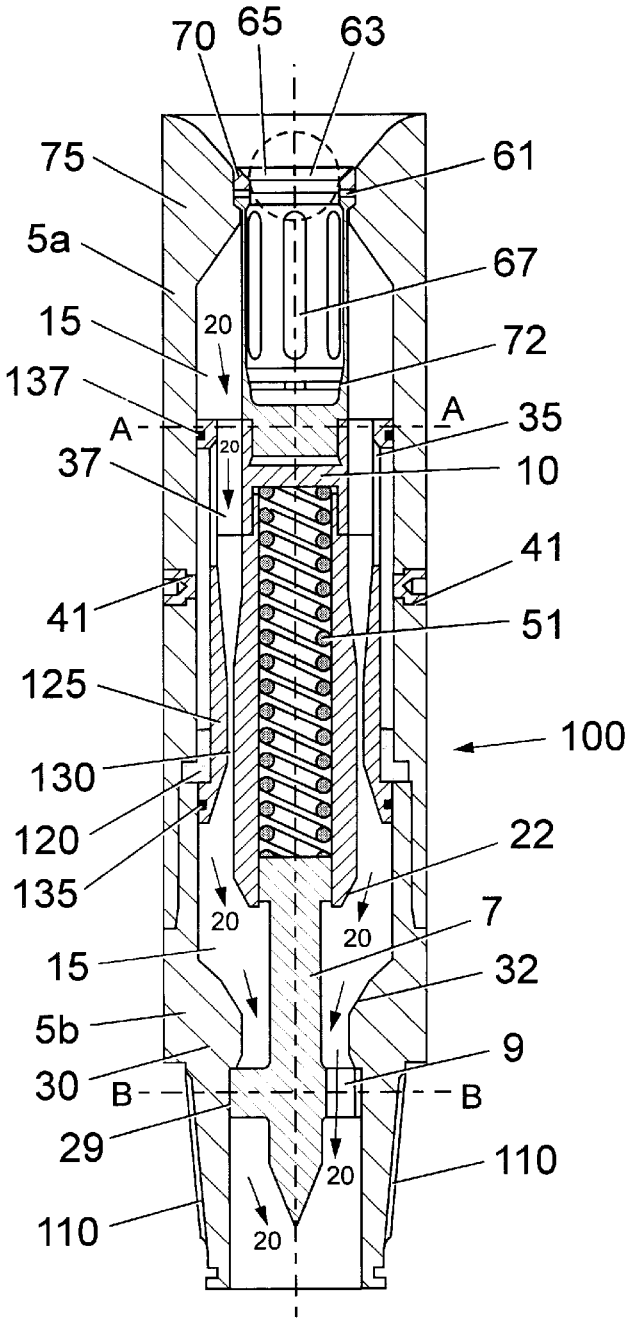
FIG. 3 is a sectional side view of a second example of tool incorporating a valve device in accordance with the present invention.
Figure 4:
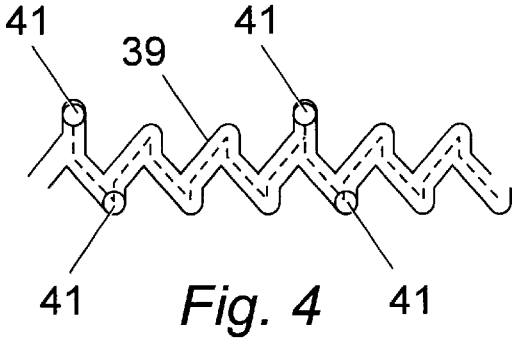
FIG. 4 is a side view of a continuous "J" slot sleeve, which is incorporated in the downhole tool of FIG. 3, laid out flat for greater clarity, and which is shown in engagement with a pin over a sequence of cycles.
Figure 5:
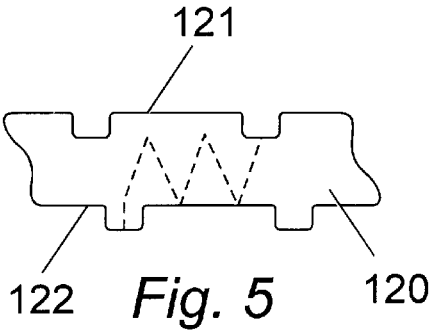
FIG. 5 is a side view of a support ring, which is incorporated in a downhole tool of FIG. 3, laid out flat for greater clarity.
Figure 6:
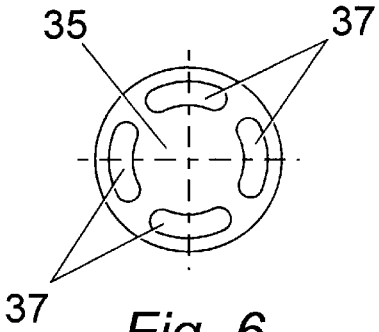
FIG. 6 is a cross-sectional view, across section A—A of FIG. 3, of a cylindrical sleeve, which is incorporated in the downhole tool of FIG. 3.
Figure 7:
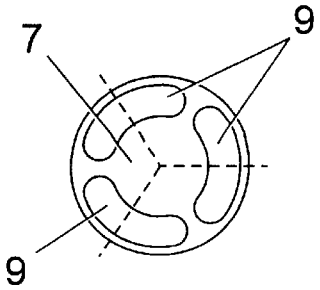
FIG. 7 is a cross-sectional view across section B—B of FIG. 3, of an inner lower body, which is incorporated in the downhole tool of FIG. 3.

A second example of a downhole tool 100, is shown in FIG. 2, and which incorporates a valve device in accordance with the present invention. In many respects, it is similar to the valve device incorporated in the downhole tool 1 and where this is so, like reference numerals indicate the same components. The downhole tool 100 comprises an upper outer body member 5*a* which is screw threaded to the lower outer body member 5*b*, thus collectively forming the outer body member 5*a*, 5*b*. At the lower end of the lower outer body member 5*b* is a pin screw thread connection 110, which can be utilised to couple the tool 100 to a sub (not shown) located in the casing string (not shown). Therefore, in this situation, the tool 100 in use is situated in the bore of the casing string, but the pin connection 110 ensures that all fluid flowing through the casing string flows through the channel 15.

Alternatively, or in addition, the tool 100 can be provided with an upper screw threaded box connection (not shown), such that the tool 100 could then replace a section of casing tubing in the casing string.

In addition to the common features that the tool 100 has with the tool 1, the tool 100 also has a lower piston section 125 which is mounted to the lower portion of the cylindrical sleeve 35. The inner surface of the lower piston section 125 is waisted inwardly toward the radially outer surface of the piston 10, and similarly the radially outer surface of the piston 10 which is aligned with the lower piston section 125 is waisted outwardly toward the lower piston section 125. This creates a very narrow channel section 130 which increases the pressure drop created, in addition to that created by the port 37. Upper 137 and lower 135 O-ring seals ensure that fluid is restrained from entering the slot 39. A support ring 120 is mounted between the upper 5*a* and lower 5*b* outer body members, and has an upper 121 and a lower 122 face which respectively butt against the lower end of the cylindrical sleeve 35 and the lower end of the lower piston section 125, when the key 41 is at the respective extremities of its travels through the slot 39. The support ring 120 therefore bears the load of the piston 10, rather than the key 41.

Figure 8:
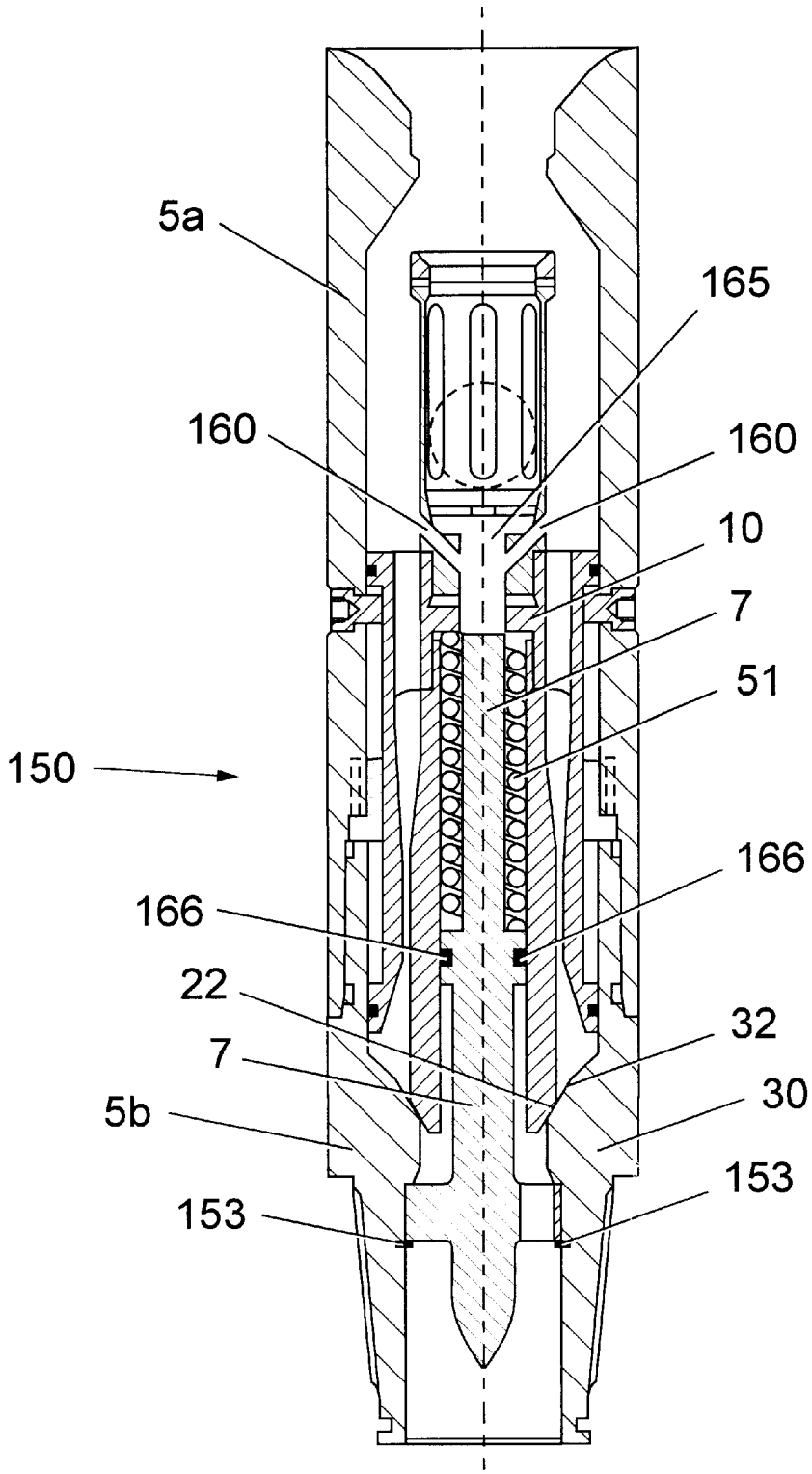
FIG. 8 is a sectional side view of a third example of a downhole tool incorporating a valve device in accordance with the present invention.

FIG. 8 shows a third example of a downhole tool 150, which is broadly similar to the downhole tool 100 with like components being indicated with the same reference numerals. However, FIG. 8 shows the downhole tool 150 with the piston 10 in the second position, that is with the fluid path being blocked due to the contact between the valve 22 and the angled seat 32, subsequent to a dropped ball (shown in phantom) having being dropped down the casing string. The downhole tool 150 can be incorporated into the casing string in the same manner as the downhole tool 100, if required.

However, in addition to the components of the downhole tool 100, the downhole tool 150 has apertures 160 which lead to a fluid chamber 165. At the lower end of the fluid chamber 165 is an O-ring seal 166. Another difference is that the inner lower body member 7 is releasably secured to the lower outer body member 5B by a shear circlip 153.

Accordingly, if the downhole tool 150 reaches the second position shown in FIG. 8, and for some reason cannot move back to the first position to re-establish circulation of fluid, or it is wished to disable the tool 150 from further operation, then by further increasing the pressure above the valve 22, this increased fluid pressure will act on the lower inner body member 7 above the O-ring 166 until the breaking force of the shear circlip 153 has been reached. Therefore, the lower inner body member 7 will rapidly be ejected from the downhole tool 150 and circulation of fluid through the downhole tool 150 is re-established, albeit through the alternative fluid path 160, 165.

Therefore, the downhole tool 150 provides a means of re-establishing circulation through the casing string by further increasing the pressure of the fluid.

Alternative means for re-establishing the circulation through the casing string include providing conventional rupture or bursting discs, or a stage cementing collar located in the casing string at a point above the angled seat 32 of the inwardly facing shoulder 30, for any of the tools 1, 100, 150. Alternatively, a stopper plug could be shear pinned into the side wall of the casing above the angled seat 32 of the inwardly facing shoulder 30, such that when the fluid pressure reaches the breaking force of the shear pins, the stopper plug is ejected from the casing wall and the circulation path for the fluid is re-established. Alternatively, and if desired the pressure can be bled off as described before, and the spring 51 moves the valve 22 away from the shoulder 30, and circulation of fluid is re-established.

Alternatively, by arranging or adapting the key 41 and slot, the circulation of fluid can be re-established by means of the inner components being ejected from the tool 1, 100, 150 when the pressure of the fluid is bled off. For instance, a long travel position with an opening (not shown) to the upper surface of the cylindrical sleeve 35 could be provided, such that when the key 41 enters, and leaves, the open topped long travel position, the slot 39 no longer engages the key 41.

It should be noted that the slot 39 of the tools 1, 100, 150, could be a discontinuous slot (not shown) which could be arranged by, for example, having a short travel position at its end. Thus, when the various cycles of the fluid flow through the tools 1, 100, 150 have been completed, the valve 22 is spaced apart from the shoulder 30 and thus circulation of fluid at the end of the cycles is virtually ensured. This feature would be advantageous to virtually remove the possibility of the tools 1, 100, 150 closing during the cementing operation.

As a back-up feature, particularly when operating a liner hanger system, a prior art drop ball device as described in the introduction, may be provided above the tool 1, 100, 150 to ensure that it is possible to activate pressure operated tools.

The tools 1, 100, 150 may also be utilised to activate pressure operated liner hanging systems that attach liner strings to the bottom of casing strings. Liner hanger systems normally attach to the bottom of casing strings by a tool similar in concept to a packer, and which are activated by fluid pressure, typically in the region of 1500 p.s.i. The advantage of using the tools 1, 100 and 150 of the present invention in order to activate the hydraulic cylinders of liner hanger systems is that hydraulic shock on the liner hanger system and the geological formation will be reduced.

The inner components of the tool 1, 100, 150 at least, are optionally formed from a material that is drillable, such as an alloy which may comprise mainly aluminium, to allow the inner components, at least, of the tool 1, 100, 150 to be removed from the casing string or liner string by drilling through the tool 1, 100, 150 in the conventional drilling manner by normal drill bit sizes, if the well is to be deepened.

It will be possible to use the tools 1, 100 and 150 in conjunction with a conventional plug and seat cementing arrangement if the seat is located above the tool 1, 100 or 150 and does not interfere with the fluid flow required to activate the tool 1, 100 or 150. This would have the advantage that the plugs can still be utilised for indicating when the cement has reached its intended destination, if the plug is placed into the borehole immediately trailing the cement, since the seating of the plug and the resultant stop in fluid flow and increase in fluid pressure indicates to the operator that the cement is in place.

The tools 1, 100, 150 may be located adjacent to, or above the bottom of the casing string, in order to control the circulation of fluid, particularly cement, through and out of the casing string into the borehole.

Optionally, for setting a liner hanger system, a small bleed path (not shown) can be formed on the face of either the valve 22 or the angled seat 32, or in an appropriate place, which provides for sufficient bleed off of the pressured fluid above the valve 22, to permit the valve 22 to open but insufficient to prevent the liner hanger system from being set.

Modifications and improvements may be made to the embodiments without departing from the scope of the present invention.

What is claimed is:

1. A valve device for use down hole comprising a body member; a channel through the body member through which fluid can flow; a moveable member mounted within the body member, the moveable member comprising an obturating member for selectively obturating the channel, the movable member being moveable between a first position in which the channel is not obturated and fluid flow through the channel is permitted, and the second position in which the channel is obturated and fluid flow through the channel is substantially prevented, wherein the valve device further comprises a detachable locking device that locks the moveable member in the first position until a displacement system is actuated to unlock the detachable locking device, wherein the displacement system comprises a drop ball seat which is coupled to the moveable member, and a drop ball such that when the drop ball seat unlocks the locking device, in use.

2. A valve device according to claim 1, further comprising a narrow channel section located in the channel, and a biasing device, the narrow channel section being connected to the moveable member, and wherein the biasing device biases the moveable member in a direction substantially opposite the direction of flow of fluid, and wherein the moveable member is moved by a pressure drop of fluid over the narrow channel section, the force of which overcomes the biasing of the biasing device.

3. A valve device according to claim 1, wherein the movement of the moveable member is restrained by a restraining mechanism to a pre-determined cycle of movement in a longitudinal direction with respect to the axis of the valve device and a rotational direction about the axis of the valve device.

4. A valve device according to claim 3, wherein the restraining mechanism comprises a first member mounted on the body member and a second member mounted on the moveable member, the two members incorporating to restrain the movement of the moveable member to the pre-determined cycle.

5. A valve device according to claim 4, wherein on the first and second members is a male member and the other of the first and second members is a female member, wherein a slot is formed in the female member into which the male member sits, the slot defining the cycle of movement of the moveable member.

6. A valve device according to claim 5, wherein the slot comprises at least one short travel section slot and at least one long travel section slot.

7. A valve device according to claim 6, wherein there are more short term travel section slots than long travel section slots.

8. A valve device according to claim 6, wherein the first position of the moveable member occurs whilst the moveable member cycle is in a short travel section slot, and the second position is whilst the moveable member cycle is at the furthest travel of the long travel section slot.

9. A valve device according to claim 1, wherein the detachable locking device includes at least one shear pin that extends from one of either of the body member or the moveable member, through to a shear pin hole located in the other of the body member or the moveable member.

10. A valve device according to claim 1, wherein the drop ball seat is selectively slidably coupled to the moveable member, such that before the detachable locking device is actuated, the drop ball seat is locked to the moveable member, and after the detachable locking device is actuated, the drop ball seat is slidably coupled to the moveable member.

11. A valve device according to claim 1, wherein after the detachable locking device is actuated, the drop ball seat and drop ball move from a first drop ball seat position, to a second drop ball seat position.

12. A valve device according to claim 11, wherein when the drop ball seat is in the first drop ball seat position, the drop ball seat retains a detachable latching device mounted on the moveable member in a latching relationship with the body member.

13. A valve device according to claim 12, wherein when the drop ball seat is in the second drop ball seat position, the drop ball seat does not retain the detachable latching device, and the detachable latching device is permitted to detach from the latching relationship with the body member.

14. A valve device according to claim 11, wherein the detachable latching device comprises at least one finger mounted on the moveable member which latches onto a latching shoulder mounted on the body member.

15. A valve device according to claim 1, wherein at least a portion of the valve device is formed from a drillable material.

16. A method of preventing fluid flow down hole comprising the steps of:

inserting a body member down hole the body member having a channel through which fluid can flow, a moveable member mounted within the body member, the moveable member comprising an obturating member for selectively obturating the channel, and the moveable member being locked by a detachable locking device in a first position in which the channel is not obturated and fluid flow through the channel is permitted;

actuating a displacement system to unlock the detachable locking device, wherein said actuation is achieved by landing a ball on a drop ball seat provided in the displacement system, the drop ball seat being coupled to the moveable member and increasing the force of fluid pressure up stream of the drop ball seat so as to unlock the locking device; and increasing the fluid flow to create a pressure drop over the moveable member and move the moveable member from the first position to a second position in which the channel is obturated and fluid flow through the channel is substantially prevented.

17. A method according to claim 16, wherein the moveable member is moved from the first to the second position by creation of a pressure drop in a narrow section of the channel.

18. A method according to claim 16, further comprising a step of re-establishing fluid flow down hole after preventing fluid flow down hole, by increasing or reducing the pressure of the fluid flow down hole to actuate a re-circulation means to re-establish fluid flow.

* * * * *